US010152933B2

(12) United States Patent
Kuo et al.

(10) Patent No.: US 10,152,933 B2
(45) Date of Patent: Dec. 11, 2018

(54) DRIVING METHOD AND SYSTEM FOR LIQUID CRYSTAL DISPLAY

(71) Applicant: Sitronix Technology Corp., Hsinchu County (TW)

(72) Inventors: Wen-Yuan Kuo, Hsinchu County (TW); Chia-Hung Wei, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 59 days.

(21) Appl. No.: 15/049,134

(22) Filed: Feb. 21, 2016

(65) Prior Publication Data

US 2016/0372075 A1 Dec. 22, 2016

Related U.S. Application Data

(60) Provisional application No. 62/180,631, filed on Jun. 17, 2015.

(51) Int. Cl.
*G09G 3/36* (2006.01)

(52) U.S. Cl.
CPC ..... *G09G 3/3614* (2013.01); *G09G 3/3655* (2013.01); *G09G 2320/0257* (2013.01); *G09G 2320/103* (2013.01); *G09G 2330/026* (2013.01); *G09G 2330/027* (2013.01)

(58) Field of Classification Search
CPC .. G09G 3/3696; G09G 3/3614; G09G 3/3688; G09G 3/3677; G09G 3/3406; G09G 3/3648; G09G 2230/00; G09G 2310/0202; G09G 2320/0257; G09G 2320/103
USPC ..... 345/96
See application file for complete search history.

(56) References Cited

U.S. PATENT DOCUMENTS

2005/0036078 A1* 2/2005 Tsunashima ..... G09G 3/3655 349/38
2006/0132413 A1* 6/2006 Chen ..... G09G 3/3406 345/94
2007/0001978 A1* 1/2007 Cho ..... G09G 3/3655 345/98
2007/0052873 A1* 3/2007 Furukoshi ..... G09G 5/006 348/790
2008/0042954 A1* 2/2008 Lee ..... G09G 3/3406 345/89
2008/0218648 A1* 9/2008 Koshihara ..... G06F 3/0412 349/37
2009/0002303 A1* 1/2009 Huang ..... G09G 3/3655 345/89

(Continued)

FOREIGN PATENT DOCUMENTS

CN 1928633 A 3/2007
CN 1971701 A 5/2007

(Continued)

*Primary Examiner* — Chineyere D Wills-Burns
(74) *Attorney, Agent, or Firm* — Winston Hsu

(57) ABSTRACT

A driving method used in a liquid crystal display (LCD) is used for preventing or mitigating an image sticking occurring on a screen of the LCD. The driving method includes driving a data line outputted to a liquid crystal capacitor on the screen with a first voltage signal; and driving a reference voltage line outputted to the liquid crystal capacitor with a second voltage signal; wherein the second voltage signal and the first voltage signal have inverse voltage polarities.

11 Claims, 5 Drawing Sheets

(56) References Cited

U.S. PATENT DOCUMENTS

| | | | | |
|---|---|---|---|---|
| 2010/0182297 | A1* | 7/2010 | Lan | G09G 3/3614 345/211 |
| 2010/0277399 | A1* | 11/2010 | Yu | G09G 3/3655 345/58 |
| 2011/0006976 | A1* | 1/2011 | Liao | G09G 3/3629 345/102 |
| 2011/0063243 | A1* | 3/2011 | Kim | G06F 3/0412 345/174 |
| 2012/0113084 | A1* | 5/2012 | Yang | G09G 3/3655 345/212 |

FOREIGN PATENT DOCUMENTS

| | | | |
|---|---|---|---|
| CN | 101261377 | A | 9/2008 |
| CN | 101364389 | A | 2/2009 |
| CN | 101866610 | A | 10/2010 |
| CN | 103003865 | A | 3/2013 |
| TW | 274606 | | 4/1996 |
| TW | 201123154 | A1 | 7/2011 |
| TW | 201220273 | A1 | 5/2012 |
| TW | 201331905 | A1 | 8/2013 |

* cited by examiner

DRIVING METHOD AND SYSTEM FOR LIQUID CRYSTAL DISPLAY

CROSS REFERENCE TO RELATED APPLICATIONS

This application claims the benefit of U.S. Provisional Application No. 62/180,631, filed on Jun. 17, 2015, the contents of which are incorporated herein by reference.

BACKGROUND OF THE INVENTION

1. Field of the Invention

The present invention relates to a driving method and system for a liquid crystal display (LCD), and more particularly, to a driving method and system capable of preventing or mitigating image sticking on a screen of the LCD.

2. Description of the Prior Art

Liquid crystal display (LCD) is the highest developed and the most popular display among various flat panel displays in the market. During the manufacture process of the LCD, ionization mismatch may appear in the liquid crystals due to several factors such as Q-time of the process, liquid crystal drop, Polyimide rubbing. In order to solve the above problem, a common method applies alternation of positive and negative polarities such as dot inversion, line inversion or frame inversion, to output display data, allowing the liquid crystal ions to be uniformly distributed across the electric fields of the liquid crystal capacitors.

However, after long time operations of the LCD, the liquid crystal ions may still approach both sides of the capacitor and may be accumulated on the electric plates, which causes imbalance of the electric field and thereby generates image sticking. With the process mismatch due to the above factors, different locations on the screen may appear different electric field distributions, such that image sticking may randomly appear in different locations. Therefore, it is hard to solve the image sticking problem by solely adjusting the reference voltage level. Thus, there is a need for improvement over the prior art.

SUMMARY OF THE INVENTION

It is therefore an objective of the present invention to provide a driving method and system for a liquid crystal display (LCD), in order to prevent or mitigate the image sticking phenomenon.

The present invention discloses a driving method used in an LCD, for preventing or mitigating an image sticking occurring on a screen of the LCD. The driving method comprises driving a data line outputted to a liquid crystal capacitor on the screen with a first voltage signal; and driving a reference voltage line outputted to the liquid crystal capacitor with a second voltage signal. The second voltage signal and the first voltage signal have inverse voltage polarities.

The present invention further discloses a driving system used in an LCD, for preventing or mitigating an image sticking occurring on a screen of the LCD. The driving system comprises a source driver and a reference voltage driver. The source driver is used for outputting a first voltage signal to a data line of a liquid crystal capacitor on the screen. The reference voltage driver is used for outputting a second voltage signal to a reference voltage line of the liquid crystal capacitor. The second voltage signal and the first voltage signal have inverse voltage polarities.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
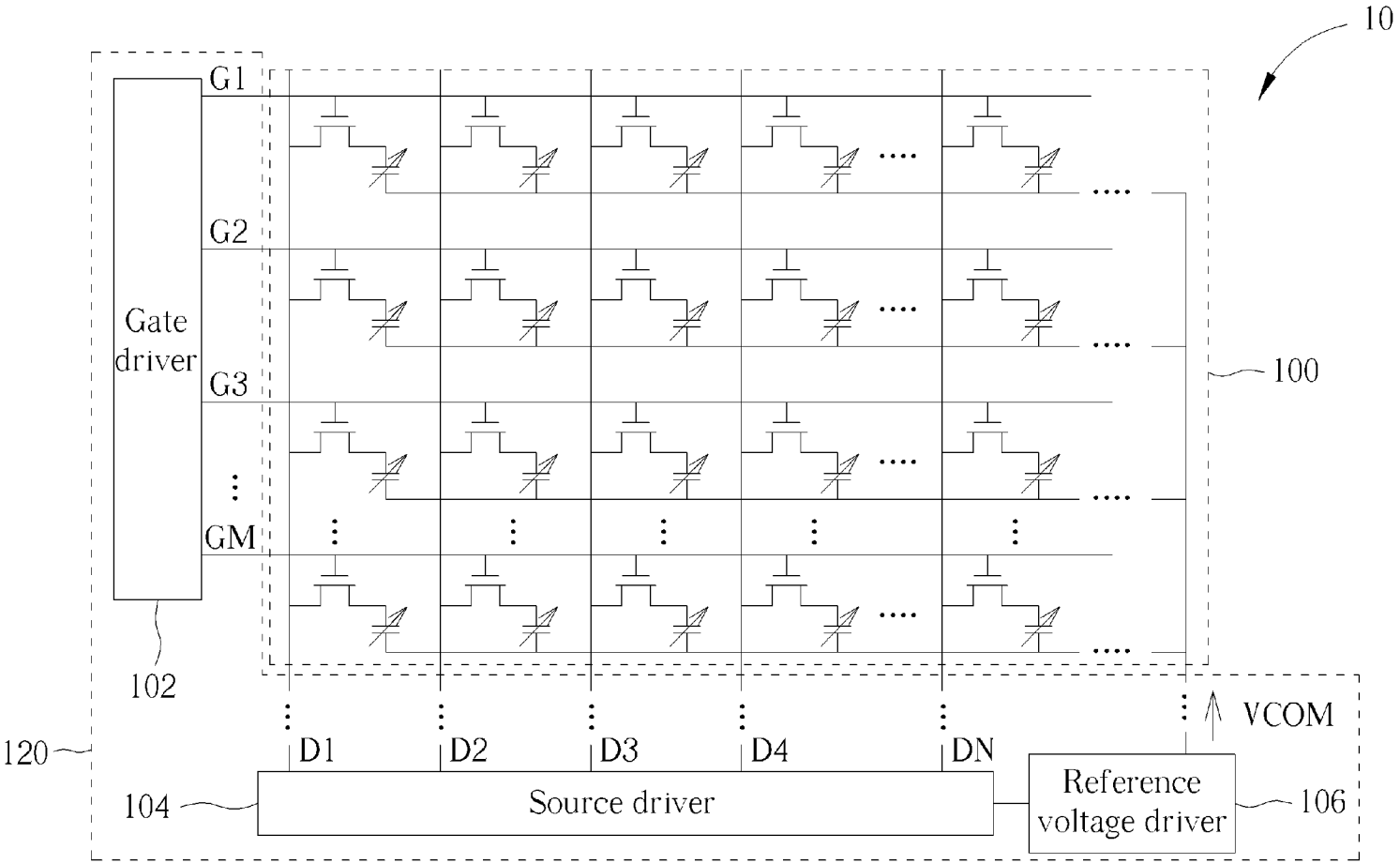
FIG. 1 is a schematic diagram of the circuit structure of a liquid crystal display (LCD) according to an embodiment of the present invention.

Please refer to FIG. 1, which is a schematic diagram of the circuit structure of a liquid crystal display (LCD) 10 according to an embodiment of the present invention. As shown in FIG. 1, the LCD 10 includes a screen 100 and a driving system 120. The screen 100 has a plurality of transistors and a plurality of liquid crystal capacitors arranged as an array, wherein each transistor corresponds to one liquid crystal capacitor. The driving system 120 includes a gate driver 102, a source driver 104 and a reference voltage driver 106. The gate driver 102 is connected to the gate terminal of the transistors on the screen 100 via a plurality of gate driving lines G1-GM, respectively, in order to output gate driving signals to control the transistors to be turned on or off. The source driver 104 is connected to the source terminal of the transistors on the screen 100 via a plurality of data lines D1-DN, respectively, in order to transmit display data to the transistors via the data lines D1-DN and then store the display data in the corresponding liquid crystal capacitors. The reference voltage driver 106 is connected to all liquid crystal capacitors on the screen 100 via a reference voltage line, in order to output a reference voltage VCOM. Please note that, in the above embodiment, the gate driver 102, the source driver 104 and the reference voltage driver 106 are independently deployed in the LCD 10, but in another embodiment, the reference voltage driver 106 may be integrated in the source driver 104 or combined with the source driver 104 in a chip module; this is not limited herein.

Figure 2:
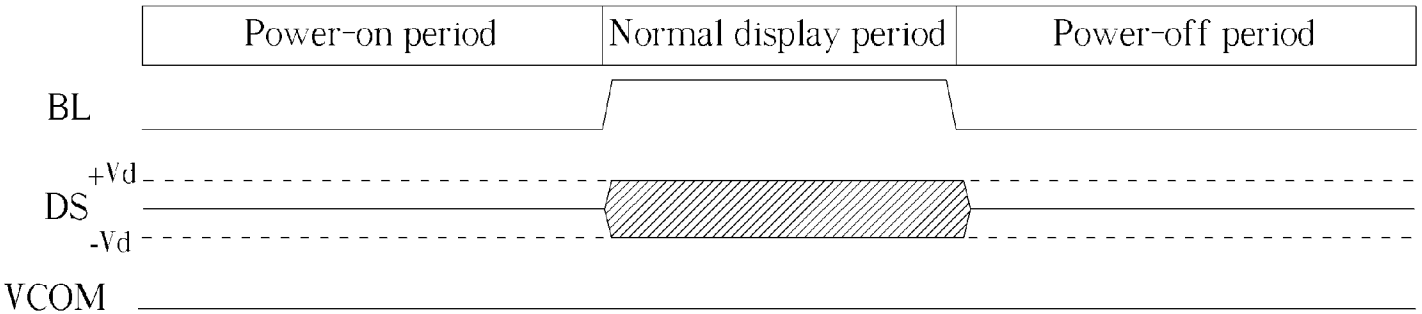
FIG. 2 is a waveform diagram of an LCD performing data display.

Please refer to FIG. 2, which is a waveform diagram of an LCD performing data display. In general, the data display may be divided into three periods: a power-on period, normal display period and power-off period. FIG. 2 illustrates the waveforms of a backlight signal BL, a data signal DS and the reference voltage VCOM during the abovementioned three periods. The backlight signal BL turns on the backlight module only in the normal display period, to display an image on the screen. The backlight module is turned off during the power-on period and the power-off period. The data signal DS switches through any voltage levels between a maximum voltage +Vd and a minimum voltage −Vd during the normal display period according to the data to be displayed, and remains on a zero voltage level during the power-on period and the power-off period. Note that the data signal DS refers to the data outputted to any of the data lines D1-DN of the LCD 10 shown in FIG. 1. In practice, each data line D1-DN may transmit the same or different data signals according to the image content to be displayed. In addition, the reference voltage VCOM may output a fixed voltage approaching or equal to the zero voltage level during the power-on period, the normal display period and the power-off period.

Figure 3:
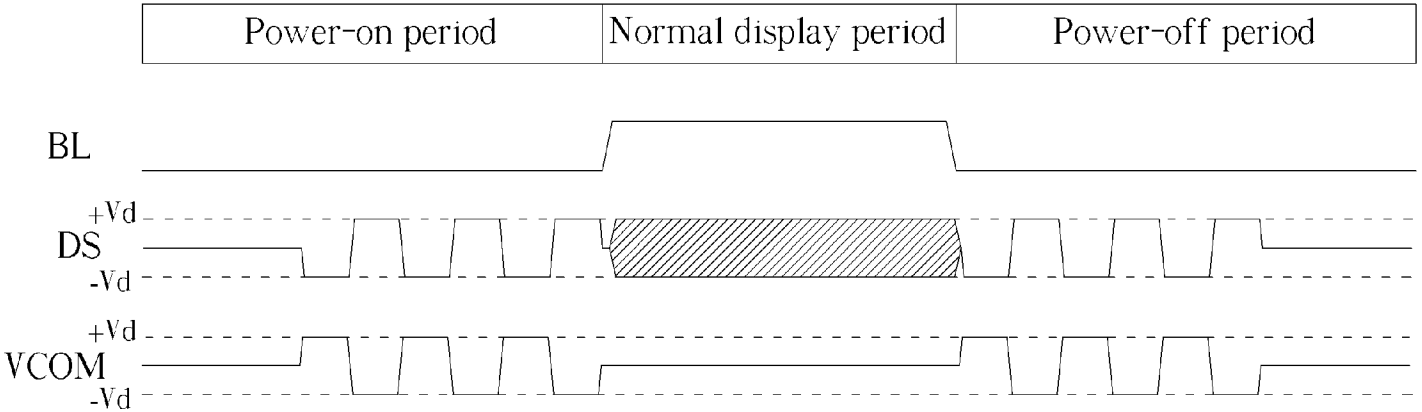
FIG. 3 is a waveform diagram of an LCD performing a driving method to prevent image sticking according to an embodiment of the present invention.

FIG. 3 is a waveform diagram of an LCD (e.g., the LCD 10 shown in FIG. 1) performing a driving method to prevent image sticking according to an embodiment of the present invention. Similarly, the waveforms shown in FIG. 3 also include three periods: the power-on period, normal display period and power-off period. The difference between the signal waveforms of FIG. 3 and FIG. 2 is that, in FIG. 3, the voltage value of the data signal DS keeps switching between the maximum voltage +Vd and the minimum voltage −Vd to form a rectangular wave and the voltage value of the reference voltage VCOM correspondingly keeps switching between the minimum voltage −Vd and the maximum voltage +Vd to form an inverse rectangular wave during the power-on period and the power-off period (i.e., the periods when the backlight source is turned off and the LCD does not display). In such a situation, the reference voltage VCOM outputted to the reference voltage line and the data signal DS outputted to the data lines D1-DN have inverse voltage polarities, so that the two terminals of the liquid crystal capacitors may receive voltage signals having inverse polarities and keeping switching. In this manner, the ions originally attached to the electric plates may go back to the inner region of the capacitors due to continuous driving of voltages with inverse polarities, and thereby be uniformly distributed in the capacitors. On the other hand, during the normal display period when the LCD displays, the reference voltage VCOM may output a constant voltage level approaching or equal to the zero voltage, and the data signal DS outputs the display data, as similar to the case shown in FIG. 2.

Preferably, the driving method of the present invention may be implemented in the power-on period and/or the power-off period, i.e., perform the driving method when the backlight source is turned off and the LCD is not displaying. In this manner, the ions accumulated on both terminals of the liquid crystal capacitor may be eliminated without affecting image display, in order to prevent or mitigate image sticking. In addition, in the embodiment shown in FIG. 3, the data signal DS and the reference voltage VCOM keep switching between the maximum voltage +Vd and the minimum voltage −Vd receivable by the screen 100, so that the voltage across the liquid crystal capacitor may achieve the maximum value within the system voltage. In another embodiment, the data signal DS and the reference voltage VCOM may be smaller than the maximum voltage +Vd or larger than the minimum voltage −Vd. As long as the data signal DS and the reference voltage VCOM are driven to generate voltage values with different voltage polarities and outputted to the liquid crystal capacitor simultaneously, the driving method should be included in the scope of the present invention. In addition, in the embodiment shown in FIG. 3, the data signal DS may be outputted to all data lines on the screen, allowing all transistors to receive the same data signal to eliminate the ions accumulated on the two terminals of the liquid crystal capacitors. In other words, all data lines on the screen simultaneously receive the data signal DS which has a voltage value keeping switching between the negative polarity and the positive polarity, and all reference voltage lines on the screen simultaneously receive the reference voltage VCOM which has a voltage value keeping switching between the positive polarity and the negative polarity. In another embodiment, different data lines may receive different data signals according to the polarity inversion scheme applied to the LCD and the related circuit structure of the source driver.

Figure 4:
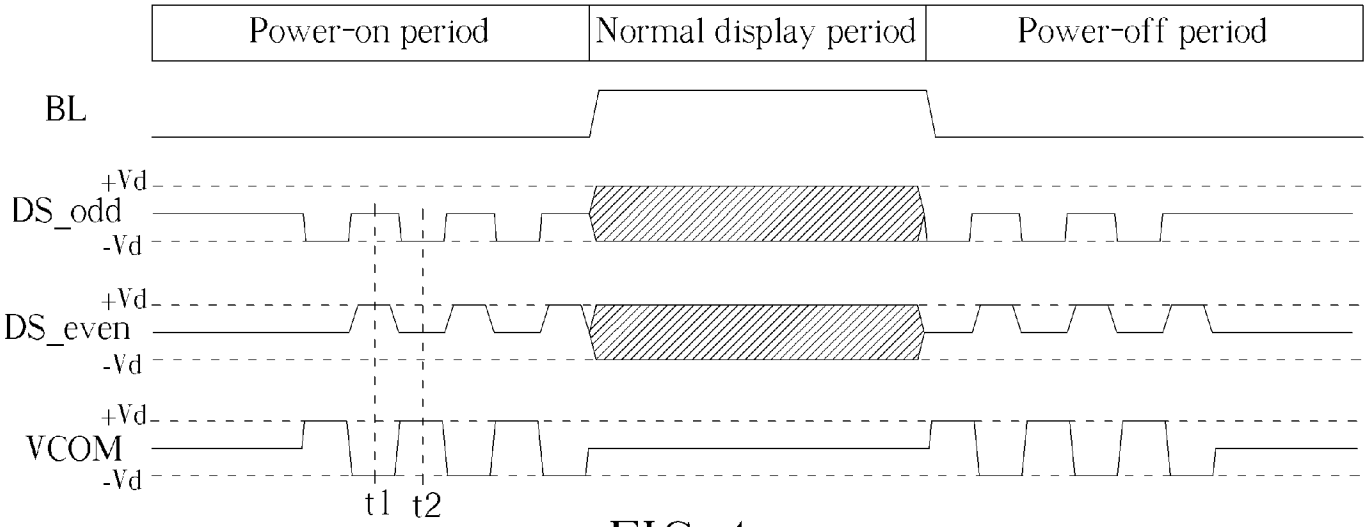
FIG. 4 is a waveform diagram of an LCD performing another driving method to prevent image sticking according to an embodiment of the present invention.

In detail, please refer to FIG. 4, which is a waveform diagram of an LCD (e.g., the LCD 10 shown in FIG. 1) performing another driving method to prevent image sticking according to an embodiment of the present invention. As shown in FIG. 4, the data signal DS may be divided into a data signal DS_odd used for odd columns of data lines (e.g., the data lines D1 and D3 shown in FIG. 1) and a data signal DS even used for even columns of data lines (e.g., the data lines D2 and D4 shown in FIG. 1). In this case, the odd columns of data lines on the screen simultaneously receive the data signal DS_odd which has a voltage value keeping switching between the negative polarity and a reference voltage level, the even columns of data lines on the screen simultaneously receive the data signal DS_even which has a voltage value keeping switching between the reference voltage level and the positive polarity, and all reference voltage lines (corresponding to odd columns and even columns of data lines) on the screen simultaneously receive the reference voltage VCOM which has a voltage value correspondingly keeping switching between the positive polarity and the negative polarity. The reference voltage level is the constant voltage level approaching or equal to the zero voltage level outputted by the reference voltage VCOM during the normal display period.

In the above embodiment, elimination of the ions accumulated on the electric plates for odd columns and even columns of liquid crystal capacitors may be realized in different time. For example, as shown in FIG. 4, at time t1, the data signal DS_even and the reference voltage VCOM have inverse voltage polarities, and the data signal DS_even is equal to the maximum voltage +Vd and the reference voltage VCOM is equal to the minimum voltage −Vd, so that the voltage across the liquid crystal capacitors located in the even columns achieves the maximum value within the system voltage. At time t2, the data signal DS_odd and the reference voltage VCOM have inverse voltage polarities, and the data signal DS_odd is equal to the minimum voltage −Vd and the reference voltage VCOM is equal to the maximum voltage +Vd, so that the voltage across the liquid crystal capacitors located in the odd columns achieves the maximum value within the system voltage. Similarly, the above voltage signals may also have a voltage value smaller than the maximum voltage +Vd or larger than the minimum voltage −Vd to perform driving, where the data signal DS_odd or DS_even should have a polarity inverse to the polarity of the reference voltage VCOM, so that a larger voltage may appear across the two terminals of the liquid crystal capacitors, in order to eliminate the ions attached to the electric plates.

Please note that one of the spirits of the present invention is to drive the reference voltage VCOM. In contrast to a general LCD where the reference voltage is always a fixed voltage approaching or equal to the zero voltage level, the present invention may drive the reference voltage VCOM to output a voltage value having a polarity inverse to the voltage polarity of the corresponding data signal DS. Therefore, the voltage across the two terminals of the liquid crystal capacitor may be larger, in order to achieve more effective ion elimination. This in turn allows the ions to be uniformly distributed in the liquid crystal capacitor, in order to prevent or mitigate occurrence of the image sticking. Those skilled in the art can make modifications and alternations accordingly. For example, the above driving method is performed when the backlight source is turned off and the LCD does not display; hence, the content displayed on the screen may not be affected no matter whether or how the driving method is performed. In such a situation, the gate driver may output the gate driving signals to the gate driving lines by any methods. In an embodiment, the gate driving lines on the screen may be driven row by row according to an order of displaying on each row of pixels, so that the liquid crystal capacitors on the screen may receive the data signal DS and the reference voltage VCOM row by row. In another embodiment, the gate driving lines may be driven in any other order, or all gate driving lines on the screen may be driven simultaneously (i.e., all transistors on the screen are turned on simultaneously), so that all liquid crystal capacitors on the screen receive the data signal DS and the reference voltage VCOM simultaneously.

In addition, the above embodiments of the present invention illustrate that the driving method may be performed when the backlight source is turned off and the LCD does not display, but in another embodiment, the driving method may also be performed during the normal display period.

Those skilled in the art should know that the image sticking most easily occurs after the screen displays the same image for a long time. This is because the long-time display of the same image pattern may cause the ions in the liquid crystal capacitors to be attached to the electric plates more easily. Therefore, the driving method of the present invention may be performed after the screen displays the same image for a long time and before the screen tends to display another different image, in order to prevent image sticking of the previous image from appearing in the newly displayed image.

Figure 5:
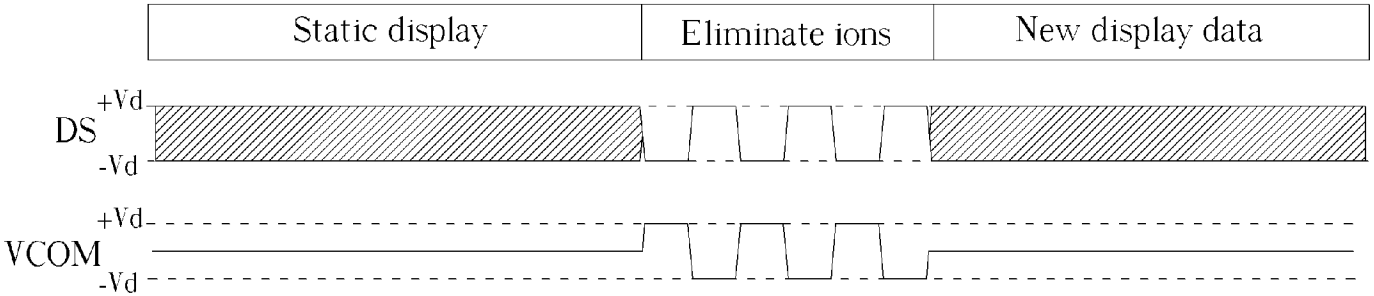
FIG. 5 is a waveform diagram of an LCD performing a further driving method to prevent image sticking according to an embodiment of the present invention.

Please refer to FIG. 5, which is a waveform diagram of an LCD (e.g., the LCD 10 shown in FIG. 1) performing a further driving method to prevent image sticking according to an embodiment of the present invention. FIG. 5 only illustrates the data signal DS and the reference voltage VCOM during the normal display period, in order to illustrate the driving method for preventing image sticking after the screen displays the same image for a long time. In this case, a control module of the LCD may detect the display data displayed on the screen when the screen displays. Subsequently, when the display data does not change for a period of time, the control module may determine that the screen enters a static display mode. When detecting that the display data tends to change in the static display mode, the control module may control the source driver 104 and the reference voltage driver 106 to respectively output the data signal DS and the reference voltage VCOM having inverse voltage polarities to the corresponding data lines and reference voltage lines in a small period before the new display data is displayed, in order to prevent image sticking from appearing in the new image after change. The data signal DS and the reference voltage VCOM may switch their polarities for several cycles to eliminate the ions accumulated on both terminals of the liquid crystal capacitors, in order to prevent or mitigate the occurrence of image sticking. During other normal display periods, the data signal DS may normally output the display data and the reference voltage VCOM may be a constant voltage approaching or equal to the zero voltage level, as shown in FIG. 5.

Figure 6:
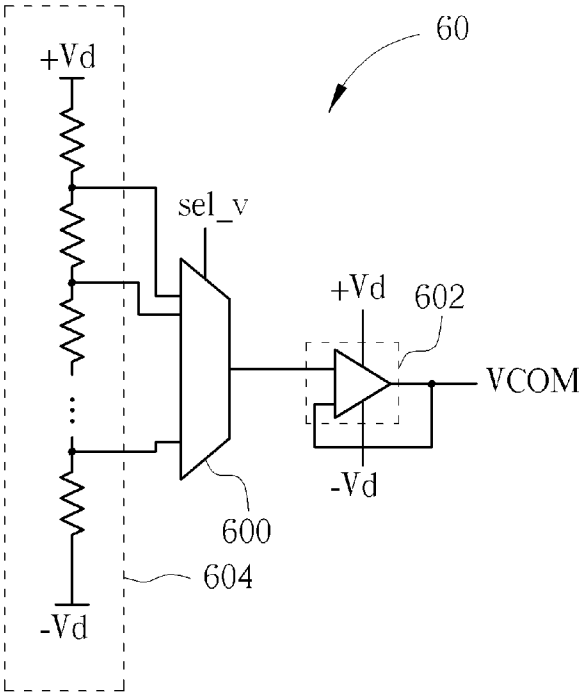
FIG. 6 is a schematic diagram of a reference voltage driver according to an embodiment of the present invention.

In an embodiment, the reference voltage driver of the present invention may be realized by a multiplexer (MUX). For example, please refer to FIG. 6, which is a schematic diagram of a reference voltage driver 60 according to an embodiment of the present invention. The reference voltage driver 60 may be the reference voltage driver 106 shown in FIG. 1, but should not be limited thereto. As shown in FIG. 6, the reference voltage driver 60 includes a MUX 600, an output stage 602 and a voltage dividing resistor module 604. The voltage dividing resistor module 604 may output several voltages between the maximum voltage +Vd and the minimum voltage −Vd to the MUX 600, allowing the MUX 600 to perform selection. The MUX 600 further receives a select signal sel_v to select a voltage among the voltages provided by the voltage dividing resistor module 604 as the reference voltage VCOM according to the voltage polarity of the data signal DS, where the selected voltage has a polarity inverse to the voltage polarity of the data signal DS. The MUX 600 then outputs the reference voltage VCOM to the reference voltage line on the screen via the output stage 602.

Figure 7:
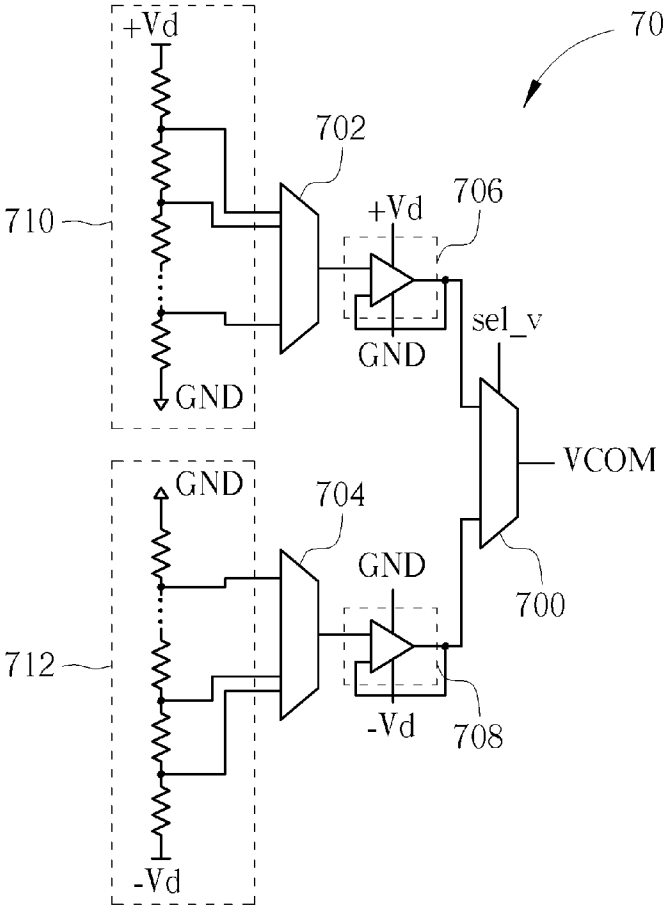
FIG. 7 is a schematic diagram of another reference voltage driver according to an embodiment of the present invention.

FIG. 7 illustrates a reference voltage driver 70 realized by multiple MUXs. The reference voltage driver 70 may be the reference voltage driver 106 shown in FIG. 1, but should not be limited thereto. As shown in FIG. 7, the reference voltage driver 70 includes MUXs 700, 702 and 704, output stages 706 and 708 and voltage dividing resistor modules 710 and 712. In this case, the positive voltage and negative voltage are separated, so that most circuit elements of the reference voltage driver 70 do not need to tolerate high voltage stress; hence, the circuit areas and costs may be reduced. In the reference voltage driver 70, the voltage dividing resistor module 710 may output positive voltages ranging between the maximum voltage +Vd and the zero voltage level GND, so that the MUX 702 may select from these positive voltages. The MUX 702 then outputs the selected voltage via the output stage 706. The voltage dividing resistor module 712 may output negative voltages ranging between the minimum voltage −Vd and the zero voltage level GND, so that the MUX 704 may select from these negative voltages. The MUX 704 then outputs the selected voltage via the output stage 708. Subsequently, the MUX 700 selects a voltage having a polarity inverse to the voltage polarity of the data signal DS from the above positive voltage and negative voltage as the reference voltage VCOM.

Figure 8:
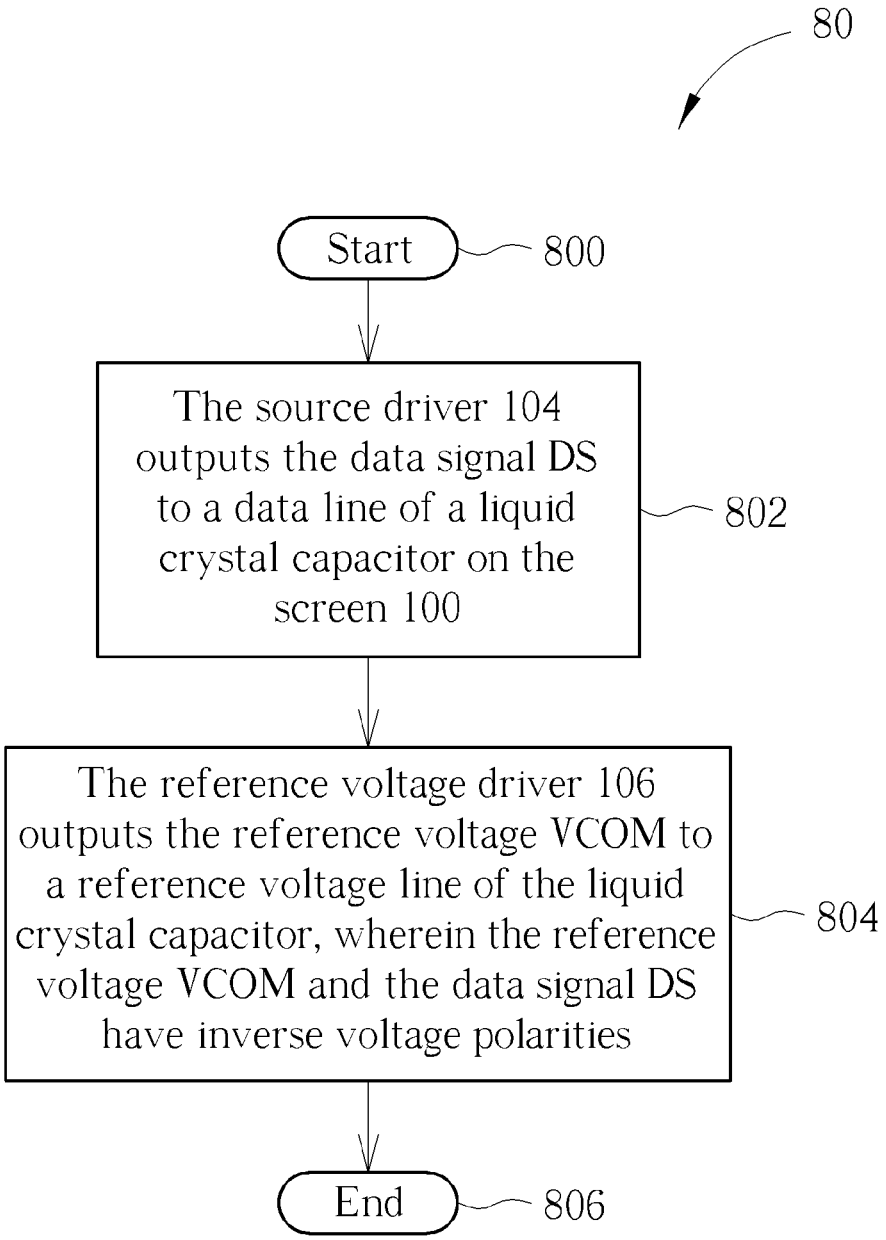
FIG. 8 is a schematic diagram of a driving process according to an embodiment of the present invention.

The above driving method for preventing or mitigating image sticking performed by the driving system 120 of the LCD 10 may be summarized into a driving process 80, as shown in FIG. 8. The driving process 80 includes the following steps:

Step 800: Start.

Step 802: The source driver 104 outputs the data signal DS to a data line of a liquid crystal capacitor on the screen 100.

Step 804: The reference voltage driver 106 outputs the reference voltage VCOM to a reference voltage line of the liquid crystal capacitor, wherein the reference voltage VCOM and the data signal DS have inverse voltage polarities.

Step 806: End.

Detailed operations and alternations of the driving process 80 are illustrated in the above descriptions, and will not be narrated herein.

To sum up, the present invention discloses a driving method for preventing or mitigating image sticking phenomenon. In the LCD, the data signal and the reference voltage may be driven by inverse voltage polarities. Since the data signal and the reference voltage may output voltage values having inverse polarities, the voltage across the two terminals of the liquid crystal capacitor on the screen may become larger, in order to achieve more effective ion elimination. Therefore, the ions in the liquid crystal capacitor may be uniformly distributed, and image sticking can be prevented or mitigated accordingly. The driving method of the present invention may be applied when the backlight source is turned off and the LCD does not display, in order to prevent the display image from being affected. In addition, according to the present invention, the data signal and the reference voltage having inverse voltage polarities may be outputted and switch their polarities for several cycles after the screen displays the same image for a long time, in order to prevent the occurrence of image sticking after the same image is displayed for a long time.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving method used in a liquid crystal display (LCD), for preventing or mitigating an image sticking occurring on a screen of the LCD, the driving method comprising: driving a data line outputted to a terminal of a liquid crystal capacitor on the screen with a first voltage signal; and driving a reference voltage line outputted to another terminal of the liquid crystal capacitor with a second voltage signal; wherein the second voltage signal and the first voltage signal have inverse voltage polarities; wherein the driving method is performed when a backlight source of the LCD is turned off and the LCD does not display; Wherein for both the power on and power off periods: when the first voltage signal reaches a maximum voltage pulse of a data signal on the data line the second voltage signal reaches a minimum voltage pulse and when the first voltage signal reaches a minimum voltage pulse of the data signal on the data line the second voltage signal reaches a maximum voltage pulse.

2. The driving method of claim 1, wherein the reference voltage line receives a reference voltage when the LCD displays, and receives the second voltage signal when the LCD does not display.

3. The driving method of claim 1, wherein a voltage value of the first voltage signal keeps switching between a negative polarity and a positive polarity, and a voltage value of the second voltage correspondingly keeps switching between the positive polarity and the negative polarity during a period when a backlight source of the LCD is turned off and the LCD does not display, so that the first voltage signal and the second voltage signal keep possessing the inverse voltage polarities.

4. The driving method of claim 1, wherein all data lines on the screen of the LCD simultaneously receive the first voltage signal which has a voltage value keeping switching between a negative polarity and a positive polarity, and all reference voltage lines on the screen simultaneously receive the second voltage signal which has a voltage value correspondingly keeping switching between the positive polarity and the negative polarity.

5. The driving method of claim 1, wherein odd columns of data lines on the screen of the LCD simultaneously receive the first voltage signal which has a voltage value keeping switching between a negative polarity and a reference voltage level, even columns of data lines on the screen simultaneously receive a third voltage signal which has a voltage value keeping switching between the reference voltage level and a positive polarity, and all reference voltage lines on the screen simultaneously receive the second voltage signal which has a voltage value correspondingly keeping switching between the positive polarity and the negative polarity.

6. The driving method of claim 1, wherein a voltage value of the first voltage signal is equal to a maximum voltage of a positive polarity or a minimum voltage of a negative polarity on the data line, and a voltage value of the second voltage signal is correspondingly equal to the minimum voltage or the maximum voltage, so that the second voltage signal and the first voltage signal have the inverse voltage polarities.

7. The driving method of claim 1, wherein all gate driving lines on the screen of the LCD are driven simultaneously, so that all liquid crystal capacitors on the screen receive the first voltage signal and the second voltage signal simultaneously.

8. The driving method of claim 1, wherein gate driving lines on the screen of the LCD is driven row by row, so that liquid crystal capacitors on the screen receive the first voltage signal and the second voltage signal row by row.

9. The driving method of claim 1, further comprising:

detecting display data on the screen when the screen displays;

determining that the screen enters a static display mode when the display data does not change for a period of time; and when detecting that the display data tends to change in the static display mode, performing the step of driving the data line and the reference voltage line respectively with the first voltage signal and the second voltage signal having the inverse voltage polarities as the display data changes.

10. A driving system, used in a liquid crystal display (LCD), for preventing or mitigating an image sticking occurring on a screen of the LCD, the driving system comprising: a source driver, for outputting a first voltage signal to a data line which is coupled to a terminal of a liquid crystal capacitor on the screen; and a reference voltage driver, for outputting a second voltage signal to a reference voltage line which is coupled to another terminal of the liquid crystal capacitor; wherein the second voltage signal and the first voltage signal have inverse voltage polarities; wherein the source driver outputs the first voltage signal and the reference voltage driver outputs the second voltage signal when a backlight source of the LCD is turned off and the LCD does not display; Wherein for both the power on and power off periods: when the first voltage signal reaches a maximum voltage pulse of a data signal on the data line the second voltage signal reaches a minimum voltage pulse and when the first voltage signal reaches a minimum voltage pulse of the data signal on the data line the second voltage signal reaches a maximum voltage pulse.

11. The driving system of claim 10, wherein the reference voltage driver comprises:

a multiplexer, for selecting to output the second voltage signal which has a voltage polarity inverse to a voltage polarity of the first voltage signal according to the voltage polarity of the first voltage signal.

* * * * *